United States Patent [19]

Katsuma

[11] Patent Number: 4,917,779

[45] Date of Patent: Apr. 17, 1990

[54] PROCESS FOR THE FORMATION OF FLUOROPLASTIC COATING ON SURFACE OF ZINC, ZINC ALLOY OR ZINC PLATING

[75] Inventor: Kunio Katsuma, Chiba, Japan

[73] Assignee: Usui Kokusai Sangyo Kabushiki Kaisha, Japan

[21] Appl. No.: 355,525

[22] Filed: May 23, 1989

[51] Int. Cl.[4] ..... C23C 28/00

[52] U.S. Cl. ..... 204/37.1; 204/38.3; 204/38.7; 204/56.1

[58] Field of Search ..... 204/37.1, 38.3, 38.7, 204/56.1

[56] References Cited

U.S. PATENT DOCUMENTS

| | | | |
|---|---|---|---|
| 3,591,468 | 7/1971 | Nishio et al. | 204/35.1 |
| 3,977,839 | 8/1976 | Palisin, Jr. | 204/38.7 X |
| 4,003,760 | 1/1977 | Labenski et al. | 148/6.2 |
| 4,114,505 | 9/1978 | Loeser et al. | 204/38.7 X |

FOREIGN PATENT DOCUMENTS

| | | |
|---|---|---|
| 18-12250 | 5/1943 | Japan . |
| 43045 | 11/1976 | Japan . |
| 60434 | 12/1982 | Japan . |

*Primary Examiner*—John F. Niebling
*Assistant Examiner*—William T. Leader
*Attorney, Agent, or Firm*—Lowe, Price, LeBlanc, Becker & Shur

[57] ABSTRACT

A fluoroplastic coating is formed on the surface of a substrate, which is selected from the group consisting of zinc, zinc alloys and zinc platings, by (i) forming an anodic oxide film on the surface of the substrate by alternating current electrolysis, (ii) dipping the substrate with the anodic oxide film formed therein in a dispersion of a fluoroplastic to coat the anodic oxide film with the fluoroplastic; and (iii) subjecting the thus-coated substrate to a heat treatment at a temperature of at least 170° C.

8 Claims, No Drawings

PROCESS FOR THE FORMATION OF FLUOROPLASTIC COATING ON SURFACE OF ZINC, ZINC ALLOY OR ZINC PLATING

BACKGROUND OF THE INVENTION (1) Field of the Invention

This invention relates to a novel process for the formation of a fluoroplastic coating on the surface of zinc, a zinc alloy or a zinc plating to impart high corrosion resistance, chemical resistance and heat resistance to the substrate.

(2) Description of the Related Art

Formation of a coating of a fluoroplastic on zinc, a zinc alloy or a zinc plating, which may hereinafter be called a "zinc substrate", has heretofore been considered unsuitable because the melting point of zinc is low in spite of the need for a rather high baking temperature for the formation of the coating from the fluoroplastic and zinc reacts with the fluoroplastic to form a compound which impairs the adhesion between the zinc substrate and the coating.

With a view toward overcoming the above difficulties, Japanese Patent Publication No. 43045/1976 discloses a process for the formation of a fluoroplastic coating having practically sufficient hardness, corrosion resistance and chemical resistance. According to the process, a zinc alloy is subjected to chromate treatment, applying a coating formulation of a special fluoroplastic of the non-sticking two-component type (for example, "TEFLON S", trade name; product of E.I. du Pont de Nemours & Co., Inc.) on the resultant film of the chromic acid and then baking the fluoroplastic at a relatively low temperature not impairing the physical properties of the zinc alloy, namely, at 140°–170° C.

Japanese Patent Publication No. 60434/1982 discloses a process for coating a zinc-plated metal article with a protective layer of a fluoroplastic. According to the process, the zinc-plated article is treated in a chromate solution having a pH of 2 or lower and containing formic acid as a reducing agent to form a chromate layer, coating the chromate-coated article with a dispersion of polyvinyl fluoride in a high boiling-point solvent and then subjecting the resultant article to a heat treatment at a temperature of at least 100° C., whereby the zinc-plated metal article is coated with the protective layer of the fluoroplastic.

On the other hand, Japanese Patent Publication No. 12250/1968 discloses the formation of a corrosion and abrasion-resistant coating on a surface of zinc or a zinc alloy by forming an anodic oxide film without relying upon a coating layer of a fluoroplastic.

In Japanese Patent Publication No. 12250/1968, the anodic oxidation of zinc or the zinc alloy is conducted using an electrolyle which contains phosphate anions and chromate anions as primary ions along with anions of at least one kind selected from molybdate anions, tungstate anions and vanadate anions and cations of at least one kind selected from sodium cations and potassium cations. The principal feature of the process resides in the use of low-voltage power for alternating current electrolysis.

Of the above-described conventional processes for the formation of a fluoroplastic coating on zinc, a zinc alloy or a zinc plating, it is essential for the former process (Japanese Patent Publication No. 43045/1976) to use a coating formulation of a modified fluoroplastic such as TEFLON S (trade name; product of E.I. du Pont de Nemours & Co., Inc.). Difficulties are therefore encountered upon selection of a resin to be employed in the process. Limitations are imposed in this regard. The above modified fluoroplastic contains one or more other resin components and is hence inferior in heat resistance and corrosion resistance. On the other hand, the latter process (Japanese Patent Publication No. 60434/1982) requires that the dipping in the dispersion of the fluoroplastic must be conducted while the chromate film has not been fully dried subsequent to the chromate treatment, in other words, while water still remains in porous hollow interstices of the chromate film layer. This is to facilitate the replacement of the remaining water with the dispersion of the polyvinyl fluoride in the high boiling-point solvent in the next step. Work-related limitations are thus imposed, leading to the need for a continuous production system which can continuously and successively perform all steps ranging from electroplating to coating.

In addition, the process of Japanese Patent Publication Nos. 43045/1976 and 60434/1982 referred to above are both adapted to apply a coating of a fluoroplastic on a chromate film which has been formed on a zinc substrate. The chromate film is formed in the form of a gel on the surface of the zinc substrate. The fluoroplastic coating cannot exhibit its inherent heat resistance fully at high temperatures and limitations are hence imposed on the conditions for the use of the product, although the fluoroplastic coating can exhibit superb effects on the corrosion resistance at room temperature.

On the other hand, Japanese Patent Publication plastic. Mere formation of an anodic oxide film can by no means bring about the above-described various properties of fluoroplastics.

SUMMARY OF THE INVENTION

With the foregoing in view, the present inventors have carried out an extensive investigation. As a result, it has been found that an anodic oxide film formed on the surface of a zinc substrate under specific conditions has high heat resistance by itself and adheres firmly with fluoroplastics and is therefore excellent as a ground coat for a fluoroplastic coating, leading to the completion of this invention.

In one aspect of this invention, there is thus provided a process for the formation of a fluoroplastic coating on the surface of a substrate selected from the group consisting of zinc, zinc alloys and zinc platings, which comprises:

(i) conducting alternating current electrolysis in an electrolytic solution, which contains a phosphoric salt at a concentration of 0.1–3 moles/l in terms of $PO_4$ and a chromic salt at a concentration of 0.1–3 moles/l in terms of $CrO_4$ and has been adjusted to pH 6-11 with at least one of sodium hydroxide and potassium hydroxide, while using the substrate as an anode, whereby an anodic oxide film is formed on the surface of the substrate;

(ii) dipping the substrate with the anodic oxide film formed therein in a dispersion of a fluoroplastic to coat the anodic oxide film with the fluoroplastic; and (iii) subjecting the thus-coated substrate to a heat treatment at a temperature of at least 170° C.

The process of this invention permits the formation of a fluoroplastic coating having excellent adhesion properties on surfaces of various zinc substrates, thereby providing products with a highly heat-, chemical- and corrosion-resistant coating layer.

The above and other objects, features and advantages of the present invention will become apparent from the following description and the appended claims.

DETAILED DESCRIPTION OF THE INVENTION AND PREFERRED EMBODIMENTS

Exemplary zinc substrates to which the process of this invention can be applied include die castings of zinc or alloys containing zinc as a principal component; and zinc-plated products obtained by applying a zinc plating on the surfaces of castings and steel articles.

In the case of zinc-plated products, the zinc platings desirably have a thickness of at least about 10 μm because the zinc platings react with an electrolytic solution upon anodic treatment. The platings may be formed by any suitable method, for example, by electroplating or hot dipping.

A description will next be made of a method for forming an anodic oxide film on the surface of a zinc substrate.

As a solution for the anodic oxidation of the surface of the zinc substrate, an electrolytic solution containing a phosphoric salt and a chromic salt is employed. The electrolytic solution contains the phosphoric salt at a concentration of 0.1–3 moles/l, preferably 0.6–1.0 mole/l in terms of $PO_4$ and the chromic salt at a concentration of 0.1–3 moles/l, preferably 0.4–0.8 mole/l in terms of $CrO_4$.

The electrolytic solution to be employed in the present invention is adjusted to pH 6-11 with either one or both of sodium hydroxide and potassium hydroxide. If the pH falls outside the above range, more zinc is dissolved from the zinc substrate and the formation of an anodic oxide film is decelerated or prohibited no matter whether the pH is higher than the upper limit or is lower than the lower limit.

It is preferable to add a fluoride in a proportion of 0.3 mole/l or less in terms of F (fluorine) to the electrolytic solution. The inclusion of a fluoride at such a low concentration upon preparation of an electrolytic solution is effective in accelerating the formation of a film and hence shortening the time required for the anodic treatment.

It is preferable to maintain the temperature of the electrolytic solution within a range of 30°–90° C., preferably 50°–70° C.

Alternating current electrolysis is then conducted in the above electrolytic solution, using as either both or one of electrodes the zinc substrate to be treated. As the time of the electrolysis goes on, a thicker electrically-resistant film is formed on the surface of the zinc substrate and the current tends to decrease. Accordingly, so-called "constant-current electrolysis" is conducted to increase the voltage to maintain the current constant. If the voltage is increased quickly to maintain the current constant, spark discharges occur on the surface of the electrode. It is important for the present invention to stop the electrolysis before the initiation of such spark discharges. To form the anodic oxide film as a ground coat for the subsequent coating of the dispersion of the fluoroplastic, it is suitable to conduct the electrolysis in the above electrolytic solution until the voltage reaches 20 V or lower, desirably 15–17 V. If the electrolysis should be continued until spark discharges takes place, the adhesion properties of the coating will be deteriorated on the contrary.

Upon completion of the oxidation treatment, the zinc substrate is pulled out of the electrolytic solution, rinsed thoroughly, and then dried.

The film thus formed on the surface of the zinc substrate by the anodic oxidation treatment appears to have a composition which comprises $ZnCrO_4$, $ZnPO_4$, $CrO_4$, ZnO, $CrO_3$, etc. Its surface has brown or black color. The film has a thickness of about 2–5 μm and is excellent in corrosion resistance and heat resistance. A microscopic observation of the anodic oxide film shows the formation of minute cracks in the film. These cracks are believed to facilitate the penetration of the emulsion of the fluoroplastic to be coated in the next step and also to give excellent anchoring effects for the resultant coating of the fluoroplastic, whereby the coating of the fluoroplastic have excellent adhesion properties.

The coating of the fluoroplastic is conducted using a dispersion containing a fluoroplastic such as polyvinyl fluoride or polyvinylidene fluoride at a concentration of 20–50% in a suitable solvent. The substrate with the anodic oxide film is dipped in the suspension. After being pulled out of the suspension, excess resin is removed by air blow if necessary. The substrate is thereafter subjected to a heat treatment at 170°–280° C. for 2–5 minutes, followed by cooling to harden the resultant coating. In the manner described above, the fluoroplastic coating having excellent adhesion properties and superb heat resistance and corrosion resistance is formed on the surface of the zinc substrate.

The present invention will hereinafter be described in further detail by the following examples. It should however be borne in mind that this invention is not necessarily limited to the following examples. It will be apparent to one of ordinary skill in the art that many changes and modifications can be made thereto without departing from the spirit or scope of the invention as set forth herein.

EXAMPLE 1

Sample:

Zinc alloy die casting (ZDC2)

Electrolytic solution:

Chromic anhydride (50 g) and sodium dihydrogenphosphate dihydrate (240 g) were dissolved in water (1 l), followed by addition of sodium hydroxide to pH 7.

Anodic oxidation treatment:

Controlling the bath temperature at 70° C. and using the sample as one of electrodes, constant-current electrolysis was conducted by a.c. power while maintaining the current density at 20 A/dm$^2$. The voltage gradually increased from 6 V. When the voltage reached 15 V eight minutes later, the electrolysis was stopped, and the sample was pulled out of the electrolytic solution, rinsed with water and then dried. An anodic oxide film having a pale chocolate color and a thickness of 2.0 μm was formed on the surface of the zinc alloy die casting.

Coating of fluoroplastic:

The sample was dipped in a dispersion containing 30% of polyvinylidene fluoride in a latent solvent produced by Resonale Company. The thus coated sample was subjected to a heat treatment at 250° C. for 5 minutes, followed by immediate cooling in water to harden the resultant coating. A zinc alloy die casting with a 13 μm thick polyvinylidene fluoride coating applied on the surface thereof was obtained.

EXAMPLE 2

Samples:

Zinc-plated steel pipes (outer diameter: 10 mm; wall thickness: 0.7 mm).

Electrolytic solution:

Sodium chromate tetrahydrate (100 g), 97% phosphoric acid (97 g) and sodium fluorie (5 g) were dissolved in water (1 l), followed by addition of potassium hydroxide to pH 10.

Anodic oxidation treatment:

Controlling the bath temperature at 60° C. and connecting the samples to both electrode bars respectively, constant-current electrolysis was conducted by a.c. power while maintaining the current density at 40 $A/dm^2$. The voltage gradually increased from 6 V. When the voltage reached 17 V five minutes later, the electrolysis was stopped, and the samples were pulled out of the electrolytic solution, rinsed with water and then dried.

An anodic oxide film having a dark blackish brown color and a thickness of 2.5 μm was formed on the surface of each sample.

Coating of fluoroplastic:

Each sample was dipped in a dispersion containing 30% of polyvinyl fluoride in a latent solvent produced by Resonale Company. The thus-coated sample was subjected to a heat treatment for 3 minutes in hot air of 200° C., followed by cooling in water to harden the resultant coating. A zinc-plated steel pipe with a 13 μm thick polyvinyl fluoride coating applied on the surface thereof was obtained.

EXAMPLE 3

Samples:

Same as Example 2:

Electrolytic solution:

Same as Example 2:

Anodic oxidation treatment:

Electrolysis was conducted under the same bath temperature and current conditions as in Example 2. The voltage reached 70 V ten minutes later and spark discharge started taking place. The electrolysis was stopped at that stage, and the samples were taken out of the electrolytic solution, rinsed with water and then dried. An anodic oxide film having a grayish green color and a thickness of 5 μm was formed on the surface of each sample.

Coating of fluoroplastic:

Each sample was treated in a similar manner to Example 2 to coat polyvinyl fluoride as a top coat on the anodic oxide film.

COMPARATIVE EXAMPLE 1

Sample:

Same as Example 2:

Chromate treatment:

The sample was dipped in a chromate solution which had been prepared by dissolving sodium dichromate (20 g), chromic anhydride (7.5 g), sodium sulfate (5 g) and acetic acid (5 ml). The sample was then rinsed with water and dried to form a chromate film of a yellow color on the surface of the sample.

Coating of fluoroplastic

Each sample was treated in a similar manner to Example 2 to coat polyvinyl fluoride on the chromate film.

The samples obtained in Examples 1-3 and Comparative Example 1 were tested to evaluate the heat resistance and adhesion properties of the fluoroplastic coatings on the respective zinc substrates. Testing method and test results are as follows.

Testing Method

Designed was a heating and cooling cycle consisting of holding each sample for 1 hour in a high-temperature chamber of 100° C. followed by allowing the same to stand for 1 hour at room temperature. The heating and cooling cycle was repeated 5 times. The thus-prepared sample was then subjected to a 2 mm square crosshatching adhesive tape test.

Test Results The test results are summarized in Table 1.

TABLE 1

| Sample | Crosshatching adhesive tape test after 5 heating and cooling cycles | |
|---|---|---|
| Ex. 1 | 100/100 | No squares were pulled off. |
| Ex. 2 | 100/100 | No squares were pulled off. |
| Ex. 3 | 81/100 | Some squares were pulled off. |
| Comp. Ex. 1 | 28/100 | Most squares were pulled off. |

I claim:

1. A process for the formation of a fluoroplastic coating on the surface of a substrate selected from the group consisting of zinc, zinc alloys and zinc platings, which comprises:

(i) conducting alternating current electrolysis in an electrolytic solution, which contains a phosphoric salt at a concentration of 0.1–3 moles/l in terms of $PO_4$ and a chromic salt at a concentration of 0.1–3 moles/l in terms of $CrO_4$ and has been adjusted to pH 6–11 with at least one of sodium hydroxide and potassium hydroxide, while using the substrate as an anode, whereby an anodic oxide film is formed on the surface of the substrate;

(ii) dipping the substrate with the anodic oxide film formed therein in a dispersion of a fluoroplastic to coat the anodic oxide film with the fluoroplastic; and (iii) subjecting the thus-coated substrate to a heat treatment at a temperature of at least 170° C.

2. The process as claimed in claim 1, wherein the electrolytic solution contains the phosphoric salt at a concentration of 0.6–1.0 mole/l in terms of $PO_4$.

3. The process as claimed in claim 1, wherein the electrolytic solution contains the chromic salt at a concentration of 0.4–0.8 mole/l in terms of $CrO_4$.

4. The process as claimed in claim 1, wherein the electrolytic solution additionally contains a fluoride at a concentration of 0.3 mole/l or less in terms of fluorine.

5. The process as claimed in claim 1, wherein the temperature of the electrolytic solution is 30°–90° C.

6. The process as claimed in claim 5, wherein the temperature of the electrolytic solution is 50°–70° C.

7. The process as claimed in claim 1, wherein the alternating current electrolysis is stopped before spark discharges take place.

8. The process as claimed in claim 7, wherein the alternating current electrolysis is conducted until the voltage reaches 15–17 V.

* * * * *